US006322043B1

(12) United States Patent
Saervoll

(10) Patent No.: US 6,322,043 B1
(45) Date of Patent: Nov. 27, 2001

(54) FORMWORK SYSTEM

(76) Inventor: Arnfinn Saervoll, Regine Normanns vei 8 B, N-8014Hunstadmoen (NO)

( * ) Notice: Subject to any disclaimer, the term of this patent is extended or adjusted under 35 U.S.C. 154(b) by 0 days.

(21) Appl. No.: 09/242,283

(22) PCT Filed: Aug. 22, 1997

(86) PCT No.: PCT/NO97/00222

§ 371 Date: Aug. 9, 1999

§ 102(e) Date: Aug. 9, 1999

(87) PCT Pub. No.: WO98/07935

PCT Pub. Date: Feb. 26, 1998

(30) Foreign Application Priority Data

Aug. 22, 1996 (NO) ..... 963503

(51) Int. Cl.[7] ..... E04G 11/14

(52) U.S. Cl. ..... 249/44; 249/47; 249/191; 249/192; 249/194

(58) Field of Search ..... 249/33, 44, 45, 249/47, 190, 191, 192, 194, 196, 216, 219.1, 219.2

(56) References Cited

U.S. PATENT DOCUMENTS 1,552,885 * 9/1925 Seat ..... 249/44 X
3,163,911 * 1/1965 Kenney ..... 249/45 X
3,327,987 * 6/1967 Muller ..... 249/47
3,687,411 * 8/1972 Frazier ..... 249/44
3,815,862 * 6/1974 Williams ..... 249/40
4,147,322 * 4/1979 Dahlstrom ..... 249/40
5,537,797 * 7/1996 Harkenrider et al. ..... 249/43 X

FOREIGN PATENT DOCUMENTS 0 062 420 * 10/1982 (EP) .
WO 95/14837 * 6/1995 (WO) .

* cited by examiner

*Primary Examiner*—Laura A. Callo
(74) *Attorney, Agent, or Firm*—Pitney, Hardin, Kipp & Szuch LLP

(57) ABSTRACT

Formwork system for concrete casting, comprising formwork units built up of modular panels, horizontal and vertical brace rows, where horizontal channel profiles (3) are fastened to the formwork skin (4) with a constant spacing, vertical profiles (2) are resting against the horizontal channel profiles (3), horizontal flange profiles or flange pads (1) which span over four, six and so on, modules, are arranged outside the vertical profiles (2), braces are led through brace holes in the skin (4) in the three profiles (1, 2, 3) in both the formwork sides, the horizontal flange pads (1) extend over at least three vertical profiles (2), and the panels are arranged horizontally or vertically as a whole number of modules.

13 Claims, 8 Drawing Sheets

FORMWORK SYSTEM

BACKGROUND OF THE INVENTION

1. Field of the Invention

The present invention relates to formwork system in accordance with preamble to the claims.

2. Description of the Prior Art

Existing formwork systems are based on a frame system having form braces through the element joints, which in terms of strength provide an unfavourable frame structure. Further, it is a disadvantage that non uniform spacing of braces requires that opposite panels in a wall formwork must be of equal size, and that non uniform wall thickness must be met by non uniform panels sizes. This means in practice that this type of formwork must comprise many different panel sizes in order to satisfy the need for length, hight and corner matchings.

There is therefore still a need to provide better, more efficient and more profitable systems that will also permit greater freedom with respect to the design of concrete constructions.

It is desired, with more freedom than at present, to be able to fashion inside to cast concrete in such a way that it may be used in constructions that are now being made inn other materials. The needs, requirements and desires for more interesting fashioning or constructions than what is possible with the present technique for incisal casting, also effects the development of new formwork systems.

Flexibility is a result of, among other things, that the formwork may be easily combined with conventional formwork on all sides, and that in addition, an internal corner member may be adapted for rounded corners or sloping walls with a corner break, all with varying angles.

SUMMARY OF THE INVENTION

With the formwork system according to the present invention, however, are the above mentioned drawbacks and limitations eliminated, and in addition are further advantages obtained. This is achieved with the formwork system according to the present invention as it is described with the features set forth in the claims.

The formwork system according to the invention makes possible a new and more rational method of building, among other things, because corner formwork easily may be combined with a throughgoing joint reinforcement in two directions, which is a considerably more rational way of building because a building work easier can be adapted in greater casting stages, which may be important for an over all building project. It is, for example, advantageous to be able to complete the formwork for all rooms at a time.

The formwork system according to the invention provides a system with modular panels and modular brace holes that are connected in brace with three layers of crossing profiles, where two of the layers are horizontal. The first layer comprises channel profiles spaced in two modules, the second layer comprises V-profiles spaces in one module, and the third layer comprises H-profiles in two module spaces. All profiles are crossing over modular brace holes.

With the modular system one achieves like distance horizontally and vertically, so that the profiles can be used according to choice or needs. As the formwork has modular horizontal brace distance, it can be made with like pressure against all the braces, independent of the vertical panel joints. It is further achieved that opposite panels can be made with uneven size, that four or six module long H-pads (pairs) may be brace mounted with two module space in height or length, independent of the panel size. Panel joints have the same strength regardless of whether the pads are laid one, two or three modules over the joints. One has further achieved like brace distance horizontally and vertically so that H-pads also can be used at V-pads. Further, all panel sizes may be used as internal corner panel.

Calculations show that two module brace spacings two ways combined with half a module up to the lower brace row provide a favourable load distribution at high casting pressure in that equal load on the upper and lower brace rows are obtained with a filling hight of about 3.2 m (liquid pressure). In addition, the formwork has the advantage of having equal brace distance two ways at great hights. The advantage with half a module up to the lower brace row is that a one module wide panel then can be mounted with a modular brace distance both in height and side.

Because the standard H-pad has a length adapted to two or three spans of two modules each, it must lie over four or six vertical V-profiles. The H-pad's free ends over the V-pad amounts to maximum one module and half a module to each side. With a three layer bracing where of two of the layers are horizontal, the H-pad can be moved horizontal, corresponding to the pad's free ends, and have no effect regarding the pad's strength or load distribution. This condition, namely a movable pad with the respect to the panel and the movable panel with the respect to the H-pad, is utilized according to the invention for bracing of an outside corner panel and for bracing of an in-lay partial panel.

With the new corner solution, one can avoid the traditional stiff legged corner panel inside, besides achieving the following advantages. Because the load on the outside corner panel is transferred to the inside corner lock via corner braces, there is no need for a panel lock through the outside formwork. Inside corner panel can be adapted to sloping wall with a corner break or with a curved corner. One achieves a simple adaption of various wall thicknesses and various angles. Further, reinforcement can easily be brought through the outside corner panel, straight ahead or out to the side. Inside measurements will then be matched to the formwork modular basic measurements, and this can advantageously be used as a buildings main measurement.

DETAILED DESCRIPTION OF THE PREFFERED EMBODIMENTS

Figure 16:
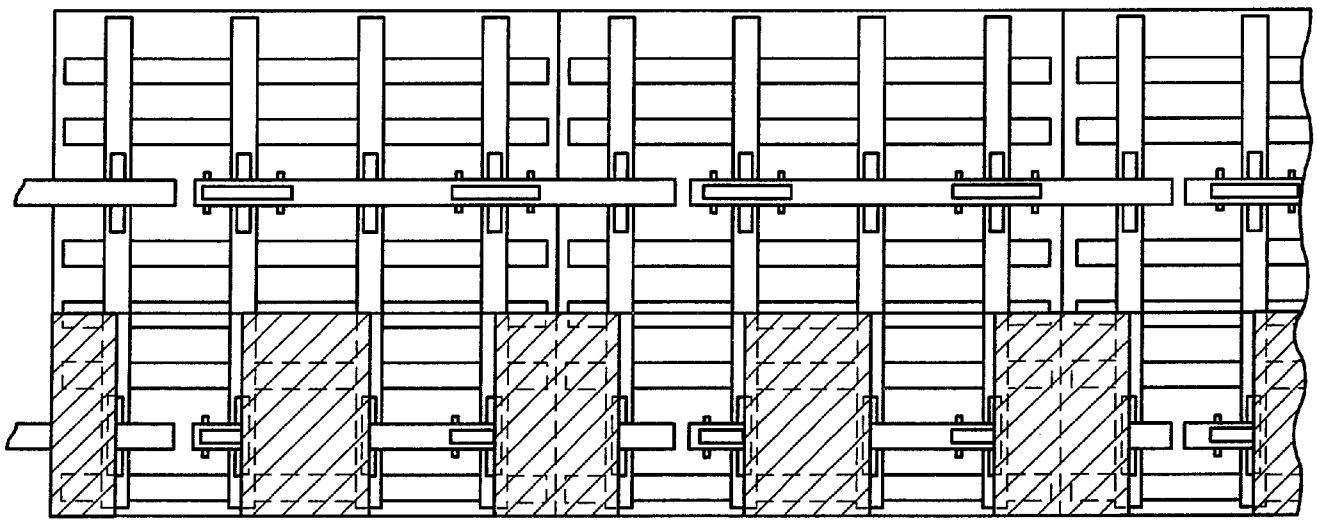
FIGS. 16 and 17 show load distribution on H-pads with and without H-pad laid over panel joint.
Figure 17:
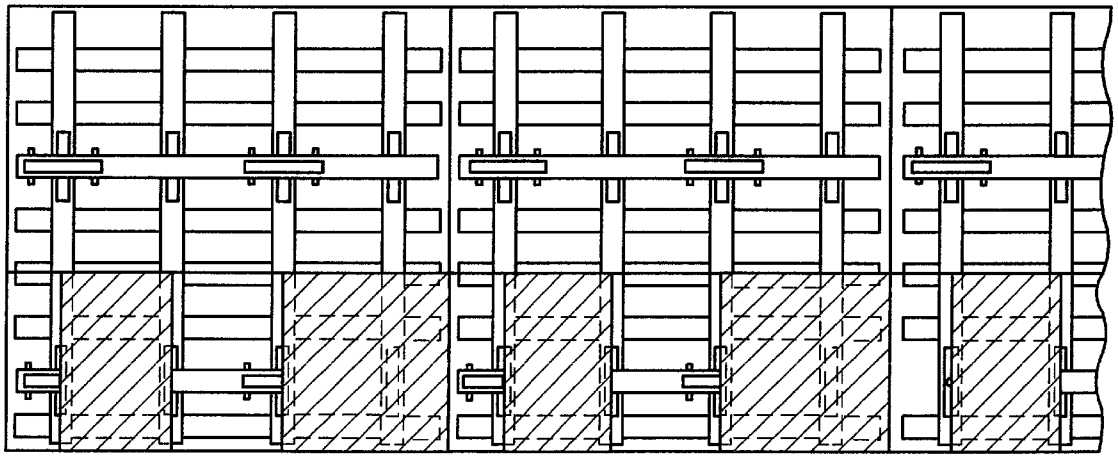
Figure 18:
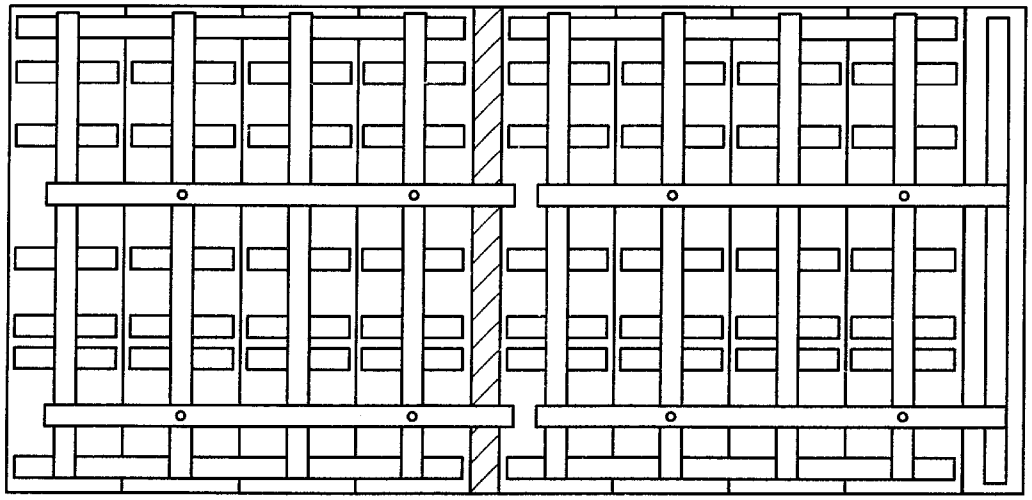
FIG. 18 shows a one by four modular panel unit.

Formwork with two modules long spans, continuous and with equal load distribution on all the spans, is possible according to the invention and that the H-pad spans over four, six (pairs) V-pads, besides that the H-pad must rest against at least one V-pad on each side of the panel joint, see FIGS. 16–18. Pads that are laid over a panel joint also provide a simple and strong horizontal alignment. Vertical panel joints have the same strength irrespective of the pads are laid, one, two or three modules over the joints, and with lay-in profiles the spans are halved.

The H-pad according to the invention has a long and a short free end out to either side from the lay-in profiles 5, 8, one lay-in profile 5 and one or more lay-in profiles 8. The lay-in profile 5 is closest to the H-pad's shorter ends. Each lay-in profile is sustained in two bolts. The brace pressure on a four module long H-pad without lay-in profile is distributed on two equal spans, with lay-in profile the brace pressure is distributed on four equal continuous spans, see FIG. 16.

Further, all panel sizes can be used both as inside and outside corner panels. A simple adaption of the wall size is achieved in that the bracing of a laid-in partial panel can be done with lying box formed pads. This is achieved by having the bracing made by three crossing profiles, two of which profiles are horizontal. In addition, the profiles have elongated openings 7 for placement of form braces.

Since the formwork has equal brace distance in two ways (and is braced with three layer profiles), all wall bracing, included bracing of D-panels, may be accomplished with only pad length, that is with four module long pads. To ways equal brace distance provides great freedom with respect to two way shaping, matching and bracing.

The formwork system according to the present invention has, compared to known systems, a very good weight/strength. This is based on the fact that the system is built up of relatively short but equal spans between form bracings, besides the effect of the lay-in profiles, which gives a very favourable load distribution and light components compared to the traditional embodiments. Light components make the system more suitable also for building of scaffoldings.

Figure 6:
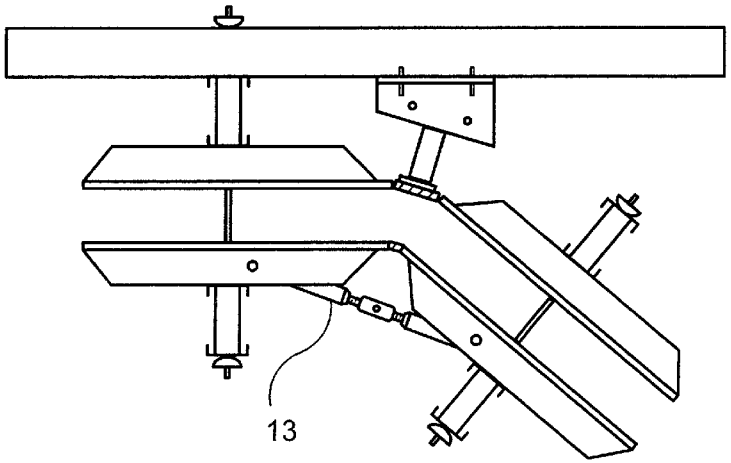
FIG. 6 shows the adaption of the corner break.
Figure 8:
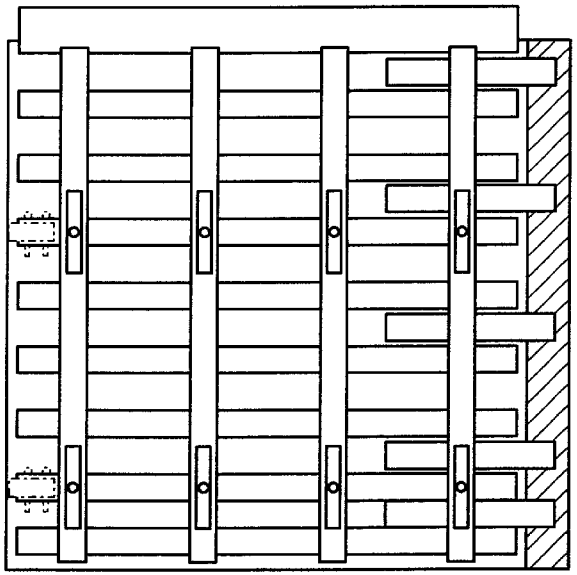
FIGS. 7 and 8 show internal corner panels.
Figure 7:
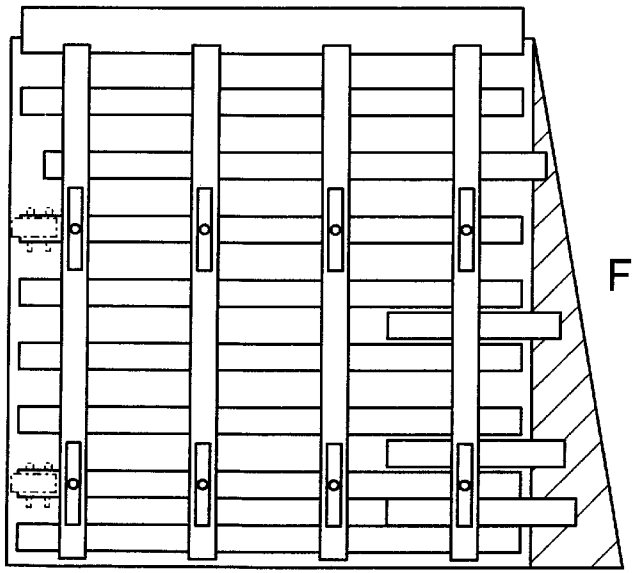
Figure 20:
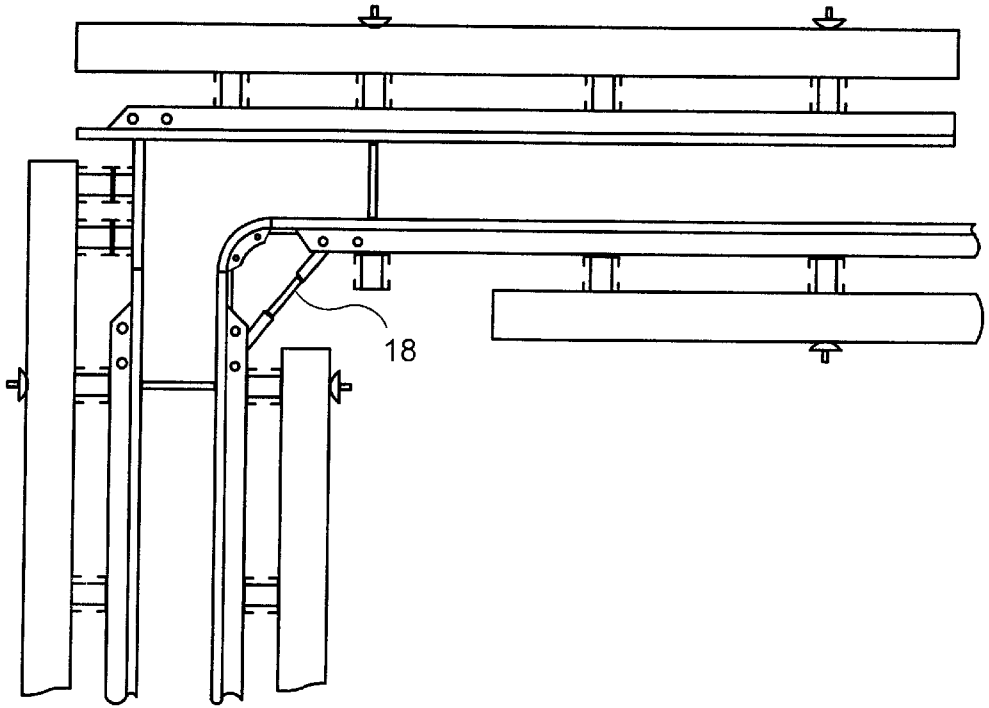
Figure 19:
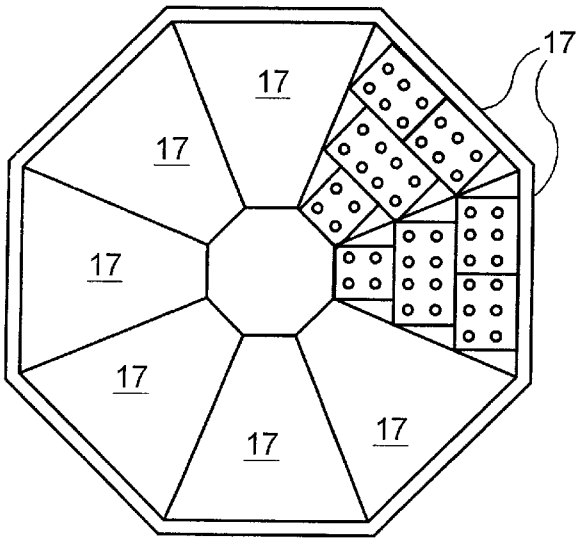
FIG. 19 shows inside corner panels adapted to a polygonal silo seen from above, and FIG. 20 show corner formwork with mounted circular inside corner panel.

FIG. 6 shows a simple adaption of wall thickness and angular dimensions, FIGS. 7, 8, 19 and 20 show examples of added inside corner panels that increase the formwork's flexibility and that a corner break can be made simply with two opposing triangular panels 17 as shown in FIGS. 7, 8 and 19, and a wall is to be cast twice in connection with cast in insulation or a pipe installation in the wall and a curved inside corner formwork 18, see FIGS. 8 and 20.

Figure 9:
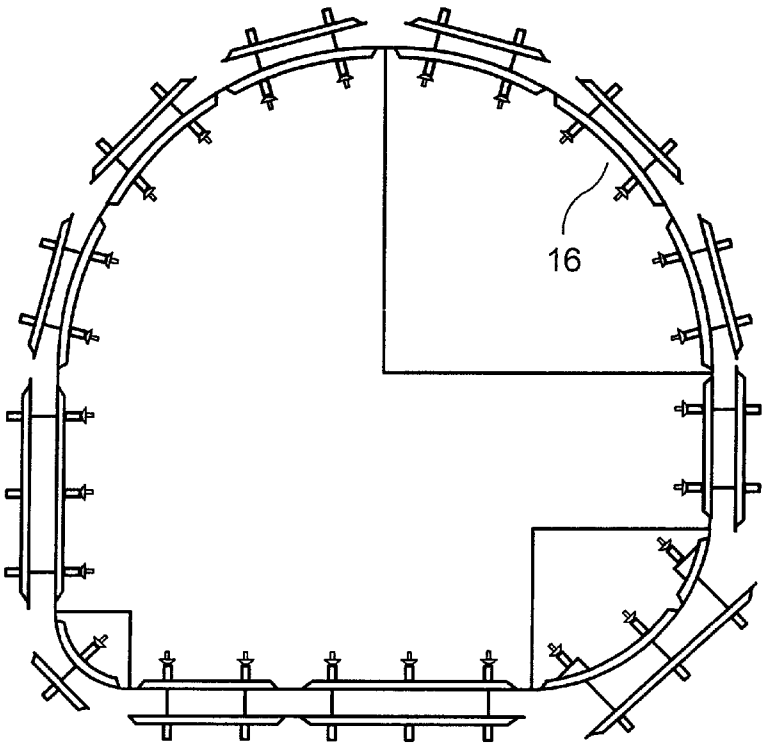
FIG. 9 shows a circular corner formwork.

FIG. 9 shows an example of an inside curved corner solution with radii of one, two or four modules respectively. Characteristic for inside circular/curved formwork is that the brace distance (one module) is the same irrespective of dimension, besides that the brace holder 16 is set at an angle with respect to the brace. The panel size is here adapted to 60°/90°. Outside bracing as for outside polygonal formwork without panel lock, see FIG. 6. This type of formwork also has the advantage that the reinforcement simply may be taken through the corner panel, straight ahead or to the side, see FIG. 10.

Compared to known systems, the system according to the present invention has significantly fewer components, but will still satisfy great requirements of flexibility. Thus, complete panel units are used where matching down to D-measurement of ¼ module, 15.625 cm, may be accomplished using only three or four panel sizes. Further, all panel sizes may be used as corner panels, both inside and outside, and bracing achieved with the use of only one pad length.

For the corner solution, the present invention provides a significant saving, in that it achieves a very simple adaption of wall thicknesses and angular dimensions. In that way it is achieved a more rational build up of the formwork. It is advantageous that outside walls or corners do not need a corner lock 13.

FIG. 16 shows four module long H-pads that are distributed on four equal spans because the use of lay-in profiles and because the H-pad is laid over panel joints. FIG. 17 shows various load distribution where H-pads are not laid over panel joints. FIG. 18 shows a four by four module panel unit built up of four (one by four) panels, adapted for manual installation. Typical for this formwork is that it must be reinforced with extended H-pads and an extra V-pad over a panel joint for each panel length so that all the spans will have equal load.

Figure 2:
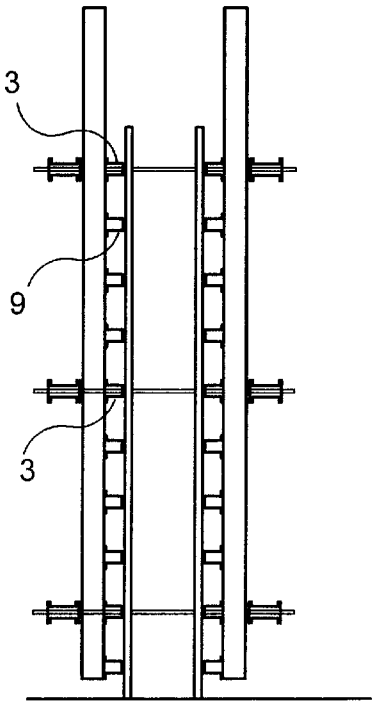
FIG. 2 shows a cross section of the wall formwork of FIG. 1.
Figure 1:
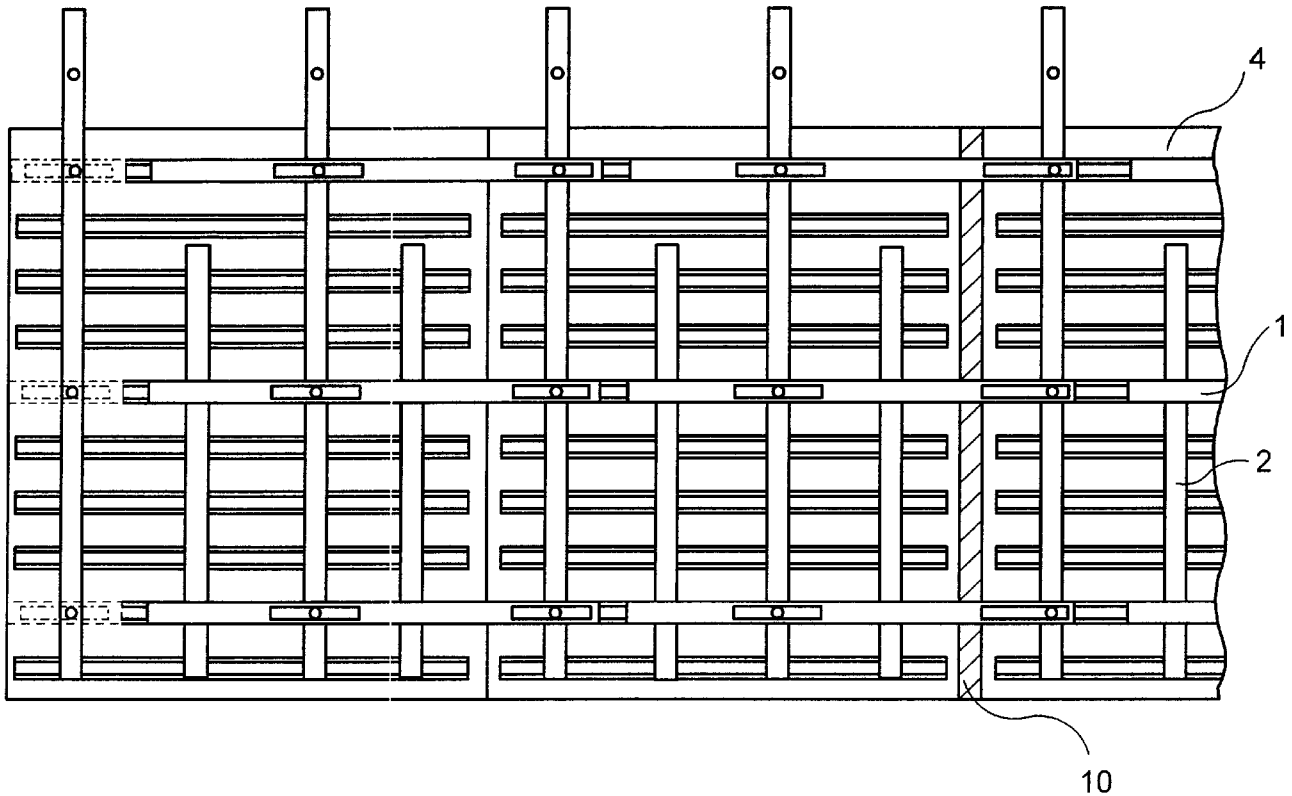
FIG. 1 shows a front view of a wall formwork according to the invention.

As shown in FIG. 1, is a five module high formwork braced with four module long pads horizontally and four or six modules long panels vertically, plus a lay-in D-panel 10 that is also braced with existing pad material (H-pad). FIG. 2 shows a five module high casting form, seen from the end, braced with a six modules long V-pad.

Figure 12:
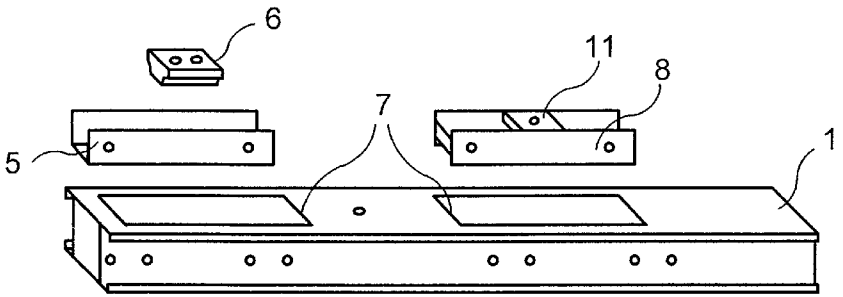
FIG. 12 shows a perspective view of an H-pad with bolt fastenings.

FIG. 12 shows a perspective drawing of a five module long flange pad and the principle of the horizontal pad 1. The pad is reinforced by having a brace anchored to the pad's brace holders 6 and 11 with lay-in profiles 5 and 8 respectively, so that the span is shorter. The lay-in profile 5 has a movable brace holder 6, and the lay-in profile 8 has a fixed brace holder 11. The removable brace holder 6 has two holes, one with and one without treads. Both the lay-in profiles 5 and 8 have equal bolt spaces. The pad 1 has openings 7 for insertion of lay-in profiles 5 and 8 respectively. By insertion of a narrow vertical D-panels, the space holder 6 is moved. Likewise is the pad displaced horizontally in connection with bracing of the corner panel and a broad D-panel. Since the normal bracing space is two modules, all adaptions may be reinforced with extra braces as needed. Light and strong pad profiles have special significance to achieve light hand based panels, and when the profiles shall be used in other connections, as e.g. scaffold building, cover supports, and so on.

Figure 13:
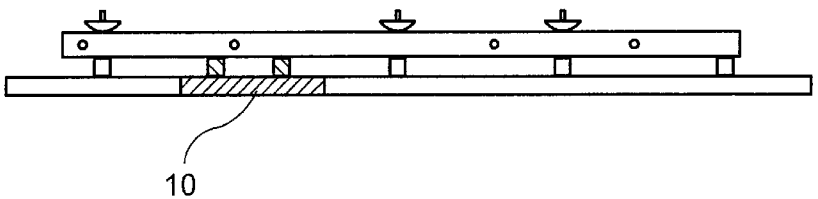
FIGS. 13 and 14 show a formwork with mounted panel and reinforced with extra bracing.
Figure 14:
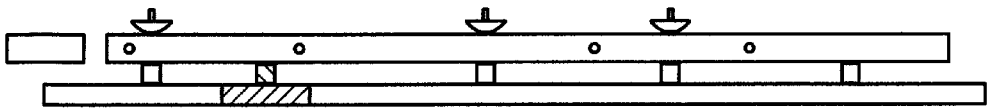
Figure 15:
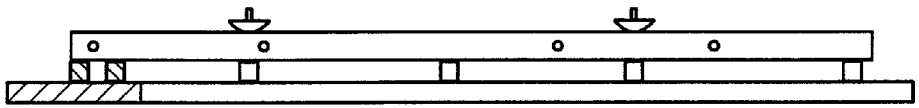
FIG. 15 shows a braced corner panel.

FIGS. 13 and 14 show formwork with inlaid D-panel and reinforced with an extra brace. FIG. 15 shows a braced corner panel where a H-pad is displaced with respect to the panel (similar to the broad D-panel on FIG. 13).

Figure 3:
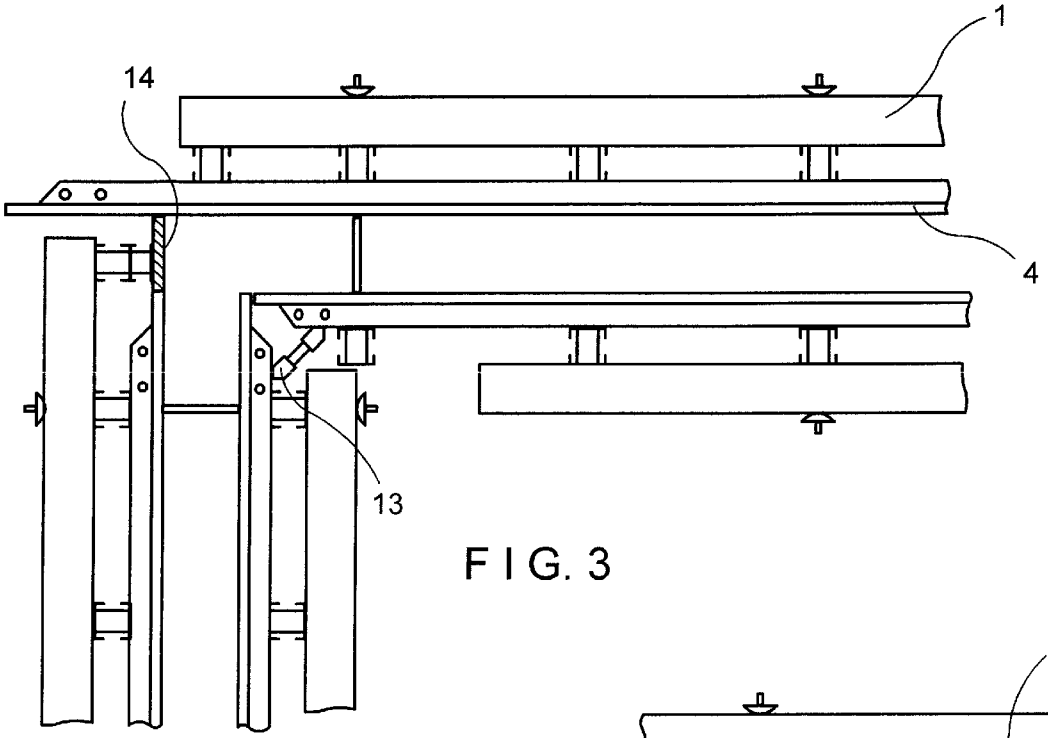
FIG. 3 shows a principle for the corner solution.

FIG. 3 shows the flexible corner solution in the formwork, where it only is need for a corner panel 14 with the size adapted to the wall thickness, plus that the bracing is performed with existing pad materials. Standard panel units can be used both inside and outside. Further, the outside panels do not need corner lock.

FIG. 19 shows inside corner panels that are adapted to a polygonal or funnel shaped silo. The silo is built according to the principle with sloping walls and the corner break in modular steps. The figure shows the silo seen from above.

FIG. 20 shows schematically a corner formwork where a circular inside corner panel is inserted. This shows the great flexibility that is achieved with the formwork system according to the invention.

Bracing of the corner panel and partial panel for matching of length is carried through without the need for extra bracing materials. In this connection see FIGS. 13–15. Further, the formwork can be locked with a panel lock only from one side, since the H-pad may be pushed forward with respect to the panel in connection with the bracing of the corner panel, since the panel may be pushed with respect to the H-pad. Inside corner panels are tied together by means of screw couplings 13 which can be turnbuckles fastened to the channel profiles. In that way all formworks, that is strait, curved, or polygonal wall formworks be tied together only from the inside. This also pertains to end closures.

By means of the lay-in profiles in the pad, as shows in FIG. 12, is obtained a very light and strong formwork with many different advantages. There are cut out openings for lay-in profiles as shown in FIG. 12. Since the lay-in profile has two suspensions, is the load reduced by half for each suspension with the same distance from suspension to the brace holder 11, the load is further distributed evenly on all spans. Halved load per span is very important with respect to the choice of the H-pad's dimensions. Especially because one H-pad without lay-in profile will have the suitable strength as the V-pad, so that the same pad could be used horizontally or vertically. This simplifies the use significantly, and the light components make the system well suited also for building of scaffolding.

Figure 4:
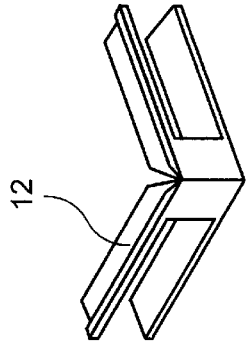
FIG. 4 shows a corner brace.
Figure 5:
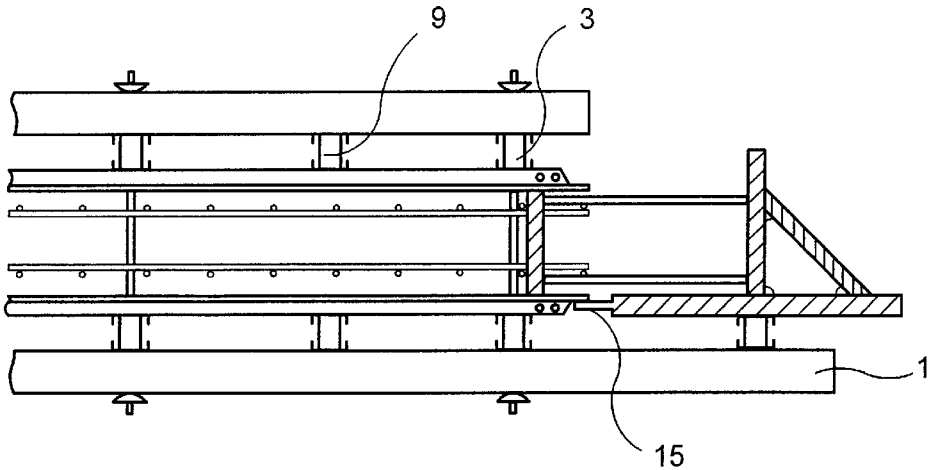
FIG. 5 shows the anchoring of an end closure.

FIG. 4 shows the formwork's corner brace 12 which can be coupled to opposite channel or scatter profile. FIG. 5 shows how an end closure is anchored and braced with internal channel profile 3 or internal H-pad 1, and pressure relieved with panel lock 15.

Figure 10:
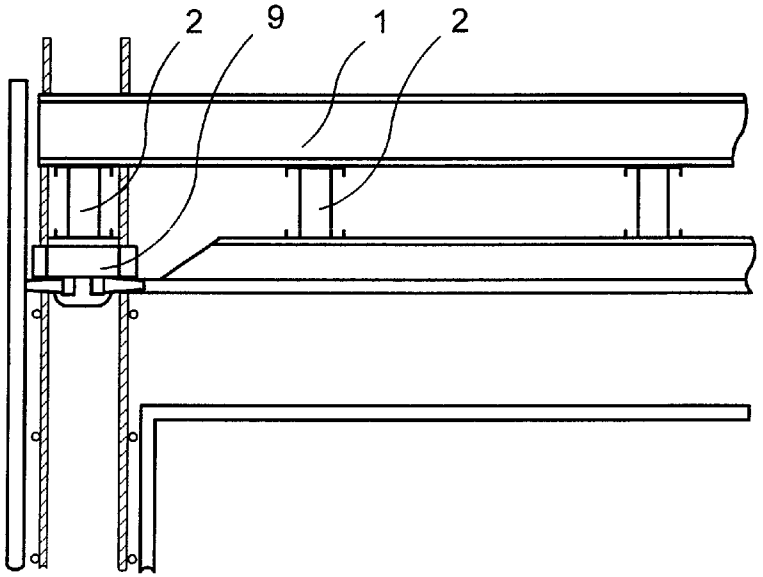
FIG. 10 shows a three parts corner panel.
Figure 11:
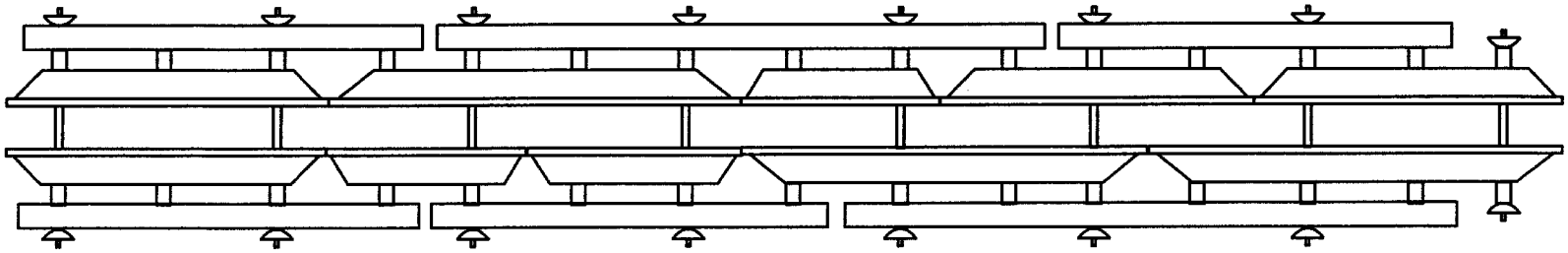
FIG. 11 shows that opposite panels may be made in various sizes.

FIG. 10 shows a detail embodiment of a three-part corner panel with throughgoing joint reinforcement. FIG. 11 shows how a wall formwork can be made with varying lengths and varying panels sizes on two opposite sides. In addition, opposite H-pads are turned with respect to each other so that a corner solution can be made with two modules brace spacings to two sides from the corner, the H-pads short and long free ends be mounted on the inside or outside of the corner formwork, see FIG. 3, because of lack of space with two pads on each corner brace.

Formwork system according to the present invention is based on the use of channel profiles 3 that are fastened to the formwork skin 4 in each frame crossing. The channel profiles 3 are arranged horizontally and with a constant vertical distance to each other.

Outside of the horizontal channel profiles 3 are placed vertical pads 2 (V-pads), also with modular spacing. Horizontal pads 1 (H-pads) are placed outside the vertical pads 2 in such a way that they run over panel joints. Also the vertical pads 2 run over horizontal panel joints. The horizontal pads 1 are fastened to the vertical pads 2 by means of flange clamps. Further, the vertical pads 2 are fastened to the channel profiles, also these with flange clamps. Scatter profiles 9 may be placed randomly, and thus are not modularized, while all the channel profiles 3 are modularized. Opposite formworks are fastened to each other with braces that run through lay-in profiles 5 and 8 and are fastened to brace holders 6 and 11 on two opposite formworks, and run through inlaid profile 5 and the flange pad 1 over to the opposite formwork. The movable brace holder 6 has two fastening holes, one with and one without threads, threaded holes being used because of lack of space in the inside corner. Channel profiles 10' and scatter profiles 9 are bevelled at the end, so that they can be used in corner solutions, and for that vertical panel joints can braced with standard profiles.

When using the formwork system according to the present invention, it is advantageous to use the inside measurements for the planned building as a main measure during the planning work, as opposed to the traditional embodiments where the outside measurements usually are used. In this way all lengths are matched with only standard panel sizes, that is two or three panel sizes in addition to the formwork's main component which is four modules wide. The module length for the formwork is chosen at 62.5 cm so that the wall hight of 250 cm can be met with four modules.

What is claimed is:

1. A formwork system for concrete casting, comprising:

formwork units including modular panels secured by horizontal brace rows and vertical brace rows;

horizontal channel profiles which are fastened to a formwork skin of the panels with constant spacing;

vertical profiles resting against said horizontal channel profiles;

horizontal flange profiles or flange pads spanning a first number of modules arranged outside said vertical profiles, wherein said first number is even and at least four;

braces placed through brace holes in said formwork skin and the horizontal channel profiles, vertical profiles and flange pads in sides of the formwork unit, wherein said horizontal flange pads extend over at least three of said vertical profiles, and wherein said panels are arranged horizontally or vertically as a whole number of modules.

2. The formwork system of claim 1 further including outside corner pads braced with said horizontal flange profiles or flange pads, wherein said horizontal flange profiles or flange pads protrude.

3. The formwork system of claim 1 wherein casting pressure on outside corner panels is transferred to an inside corner lock by corner braces and said horizontal flange profiles or flange pads, wherein said horizontal flange profiles or flange pads protrude, wherein the formwork system is free of outside panel locks.

4. The formwork system of claim 1 further including outside corner panels which have width equal to a wall thickness, whereby inside wall modular panels meet a measurement based on the module.

5. The formwork system of claim 1 further including inside corner panels which can be matched to sloping wall modular panels with a corner break.

6. The formwork system of claim 5 wherein said inside corner panels are made with a rounded corner.

7. The formwork system of claim 1 wherein a space between the horizontal channel profiles is two modules, whereby the formwork unit is mounted with horizontal brace row spacing equal to vertical brace row spacing for all panel sizes.

8. The formwork system of claim 1 wherein said horizontal flange pads have two lay-in profiles, where an end of a first lay-in profile has an adjustable brace holder, and a second lay-in profile includes a fixed brace holder.

9. The formwork system of claim 8 wherein said lay-in profiles extend through openings, and are located within a profile of said flange pads, resting against an inside wall of said flange pads.

10. The formwork system of claim 8 further including an inside curve panel including a base for said brace holder, parallel to an inside straight panel, in one module space.

11. The formwork system of claim 1 wherein fastening of said horizontal flange pads is adjustable in the longitudinal direction of said horizontal flange pads to support a corner panel.

12. The formwork system of claim 1 wherein said horizontal flange pads extend over vertical panel joints from successive vertical profiles thereby assuring that casting pressure is evenly distributed on sides of said vertical panel joints.

13. The formwork system of claim 1 wherein opposing said horizontal flange pads can be turned with respect to each other whereby a brace distance of two modules can be mounted to two sides from a corner.

* * * * *